US007990063B2

(12) United States Patent
Chang et al.

(10) Patent No.: US 7,990,063 B2
(45) Date of Patent: Aug. 2, 2011

(54) LED ILLUMINATING DEVICE

(75) Inventors: Shao-Han Chang, Taipei Hsien (TW); Wen-Hsiang Lu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/768,697

(22) Filed: Apr. 27, 2010

(65) Prior Publication Data

US 2011/0084588 A1 Apr. 14, 2011

(30) Foreign Application Priority Data

Oct. 9, 2009 (CN) ..... 2009 1 0308136

(51) Int. Cl.
*H01J 1/62* (2006.01)

(52) U.S. Cl. ..... 313/512; 362/612; 362/249.01

(58) Field of Classification Search ..... 313/113, 313/512; 362/612, 613, 249.01, 249.02
See application file for complete search history.

(56) References Cited

U.S. PATENT DOCUMENTS

| | | | | |
|---|---|---|---|---|
| 6,020,944 | A * | 2/2000 | Hoshi | 349/62 |
| 7,303,324 | B2 * | 12/2007 | Yang et al. | 362/609 |
| 7,370,999 | B2 * | 5/2008 | Feng et al. | 362/619 |
| 2010/0053959 | A1 * | 3/2010 | Ijzerman et al. | 362/235 |

* cited by examiner

*Primary Examiner* — Vip Patel
(74) *Attorney, Agent, or Firm* — Zhigang Ma

(57) ABSTRACT

An LED illuminating device includes a first LED illuminating module, a second LED illuminating module, and a connecting module. The first LED illuminating module includes a first substrate and a first group of LEDs mounted on the first substrate. The second LED illuminating module includes a second substrate carrying a second group of LEDs, a wedge shaped light guide, and a reflector. The second substrate and the reflector defines a fan shaped space therebetween to receive the wedge shaped light guide, and the projections of the first substrate and the second substrate are spaced to each other. The LED illuminating device has a large light divergence angle and good heat dissipation ability.

12 Claims, 16 Drawing Sheets

LED ILLUMINATING DEVICE

CROSS-REFERENCE TO RELATED APPLICATIONS

Related subject matter is disclosed in co-pending U.S. patent applications Ser. No. 12/768,691, entitled " LED ILLUMINATING DEVICE", and Ser. No. 12/768,694, entitled "LED ILLUMINATING DEVICE", which have the same inventors and assignees as named herein. The above-identified applications are incorporated herein by reference.

BACKGROUND

1. Technical Field

The present disclosure relates to illuminating devices and, particularly, to a light emitting diode (LED) illuminating device.

2. Description of Related Art

Compared to traditional illuminating devices, LED lights have many advantages such as high luminous efficiency, low radiation, power saving, long life, etc. Yet, LED lights still have disadvantages. Because light emitted by LEDs is directional, light divergence angle of the LED light is less than that of the traditional illuminating device. Referring to FIG. 13, the light divergence angle of the traditional light source is S1, the value of S1 is about 160 degrees. Referring to FIG. 14, the light divergence angle of an LED is S2, the value of S2 is about 60 degrees.

People have combined several LEDs in a single LED illuminating device to enlarge the light divergence angle of the LED illuminating device. Referring to FIG. 15, a ring shaped LED illuminating device using many substrates 10 is shown. Each substrate 10 carries LEDs 11. The light divergence angle of the LED illuminating device is enlarged, yet, more heat is produced by the LEDs 11 (shown as arrows) between the substrates 10, which makes the LED illuminating devices become too hot.

Thus, what is needed is a LED illuminating device with large light divergence angle and good heat dissipation ability.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
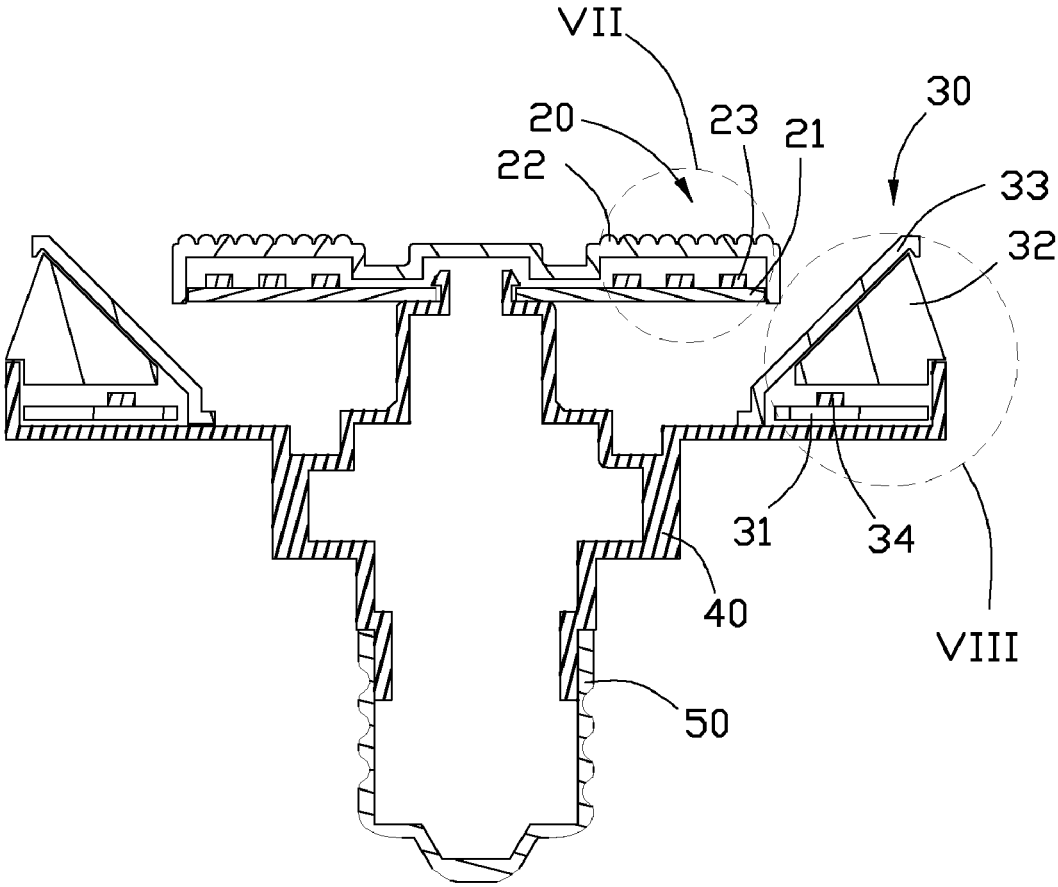
FIG. 1 is a schematic, cross-sectional view of an LED illuminating device according to a first embodiment.

Referring to FIG. 1, an LED illuminating device according to a first embodiment is disclosed. The LED illuminating device includes a first illuminating module 20, a second illuminating module 30, a connecting module 40, and a power input module 50.

The first illuminating module 20 includes a first substrate 21 and a transparent cover 22. The substrate 21 is mounted on the connecting module 40, and the transparent cover 22 is mounted on the substrate 21. The transparent cover 22 and the substrate 21 together form a first shell. A first group of LEDs 23 is mounted on the substrate 21 in the first shell.

Figure 2:
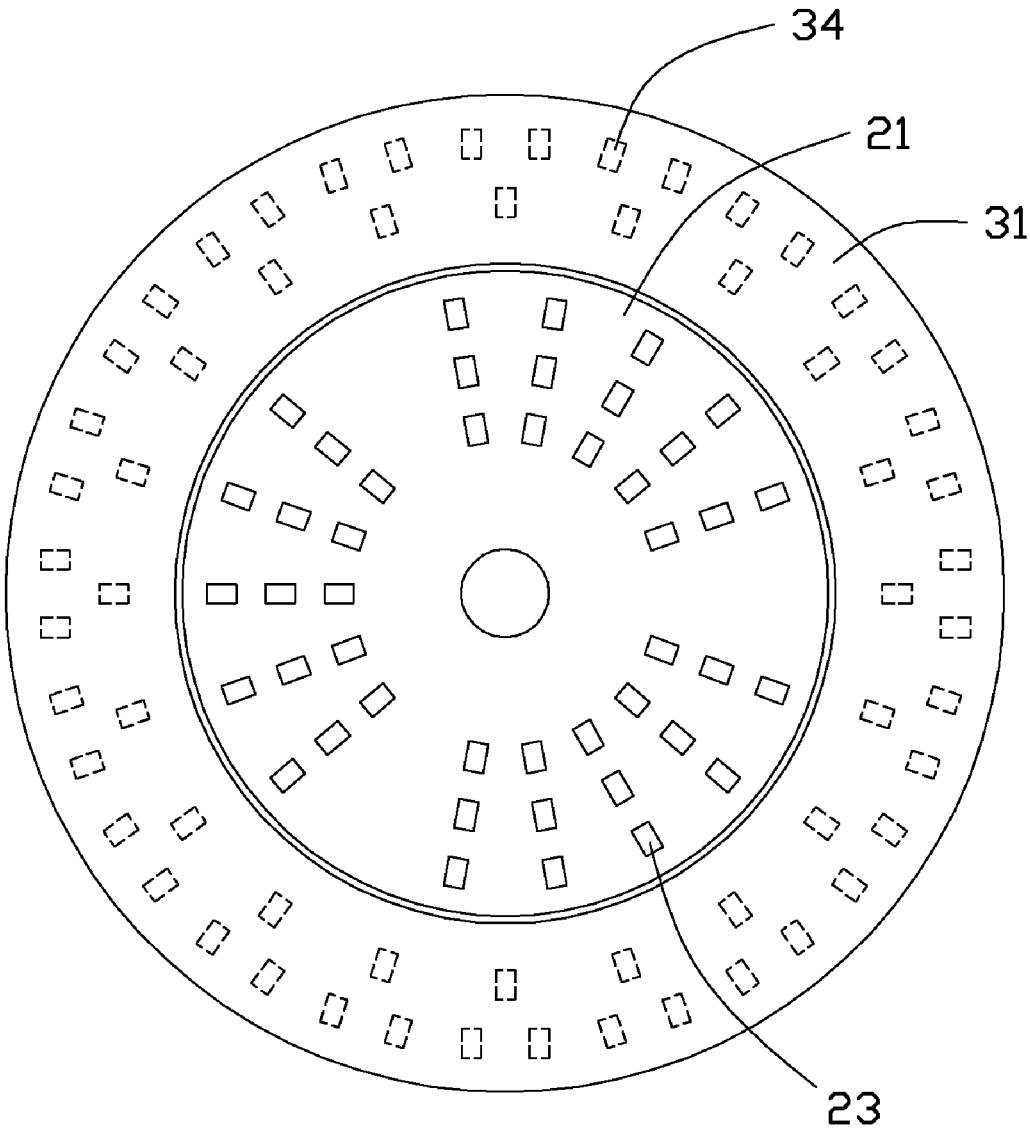
FIG. 2 is a schematic, plan view showing substrates of the LED illuminating device of FIG. 1.

The second illuminating module 30 includes a second substrate 31, a wedge shaped light guide 32, and a reflector 33. The substrate 31 is mounted on the connecting module 40. The reflector 33 is mounted on the substrate 31 adjacent the connecting module 40. The reflector 33 and the substrate 31 form a fan shaped space therebetween to receive the wedge shaped light guide 32. The substrate 31, the wedge shaped light guide 32, and the reflector 33 together form a second shell. A second group of LEDs 34 is mounted on the substrate 31 in the second shell. Referring to FIG. 2, the projections of the first substrate 21 and the second substrate 31 are spaced from each other.

Figure 3:
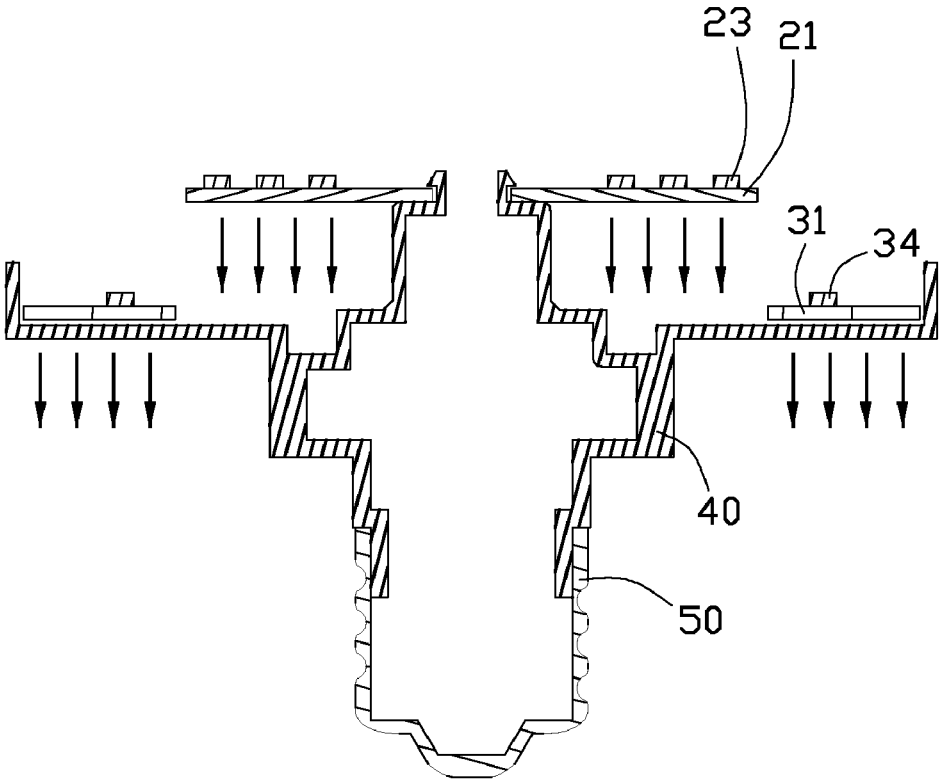
FIG. 3 is a schematic, cross-sectional view showing heat dissipation of the LED illuminating device of FIG. 1.

The first substrate 21 and the second substrate 31 face the same direction, accordingly, the first group of LEDs 23 and the second group of LEDs 34 also face the same direction. Referring to FIG. 3, heat produced by the LEDs 23, 34 and the substrates 21, 31 widely radiate along opposite directions, thus heat radiation efficiency is improved.

Figure 4:
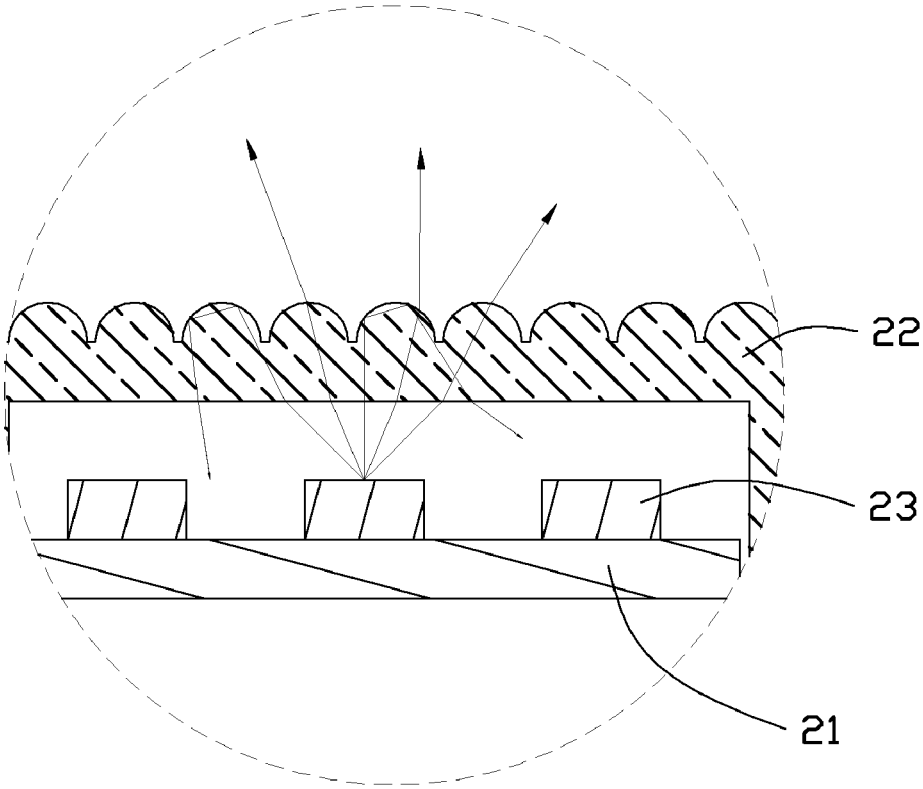
FIG. 4 is a schematic, cross-sectional view showing light characteristics of a first illuminating module of the LED illuminating device of FIG. 1.
Figure 5:
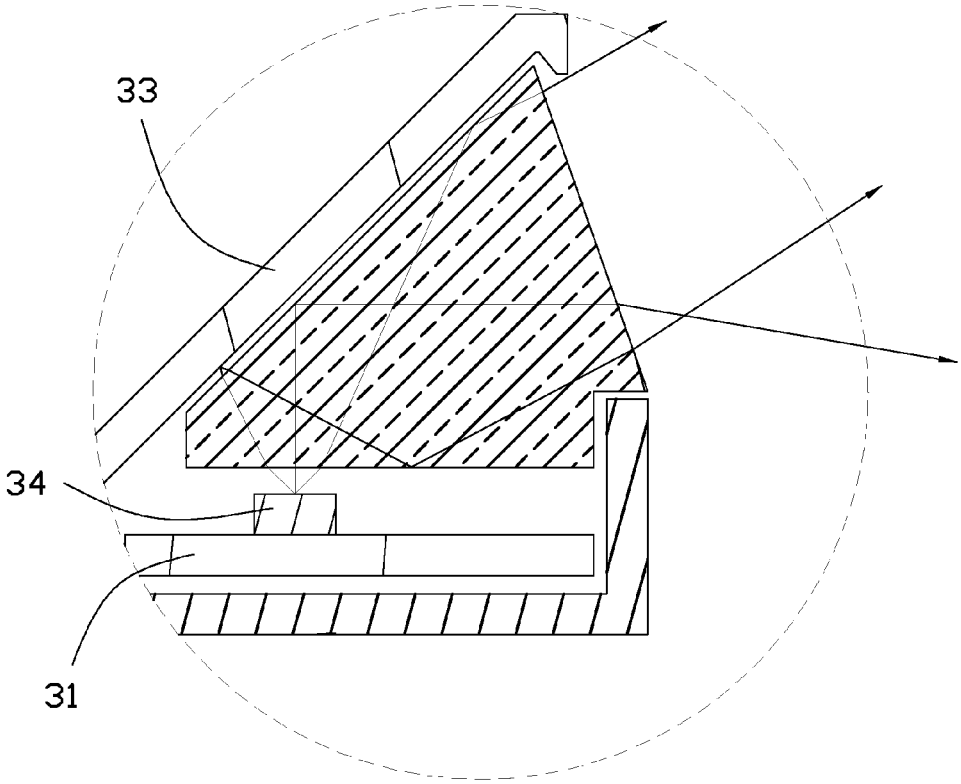
FIG. 5 is a schematic, cross-sectional view showing light characteristics of a second illuminating module of the LED illuminating device of FIG. 1.
Figure 6:
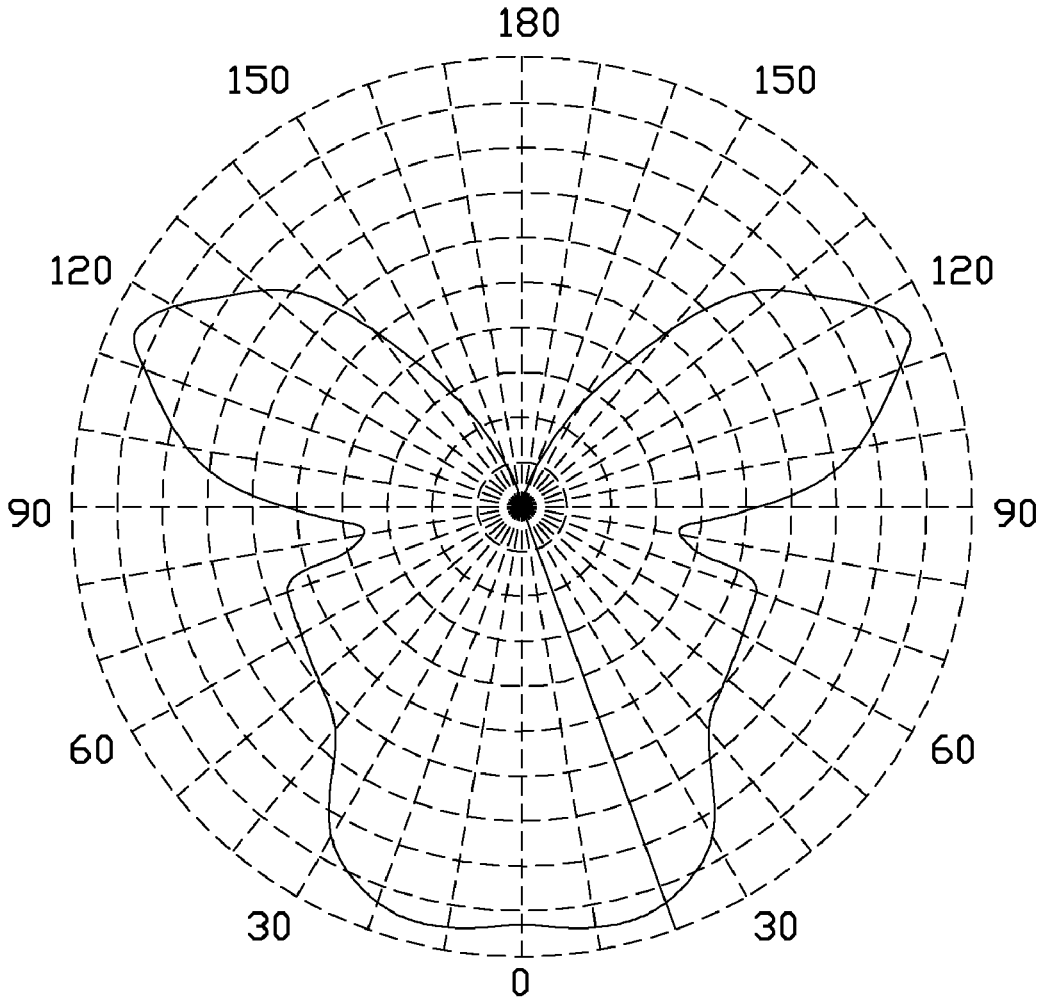
FIG. 6 is a light distribution curve chart of the LED illuminating device of FIG. 1.
Figure 7:
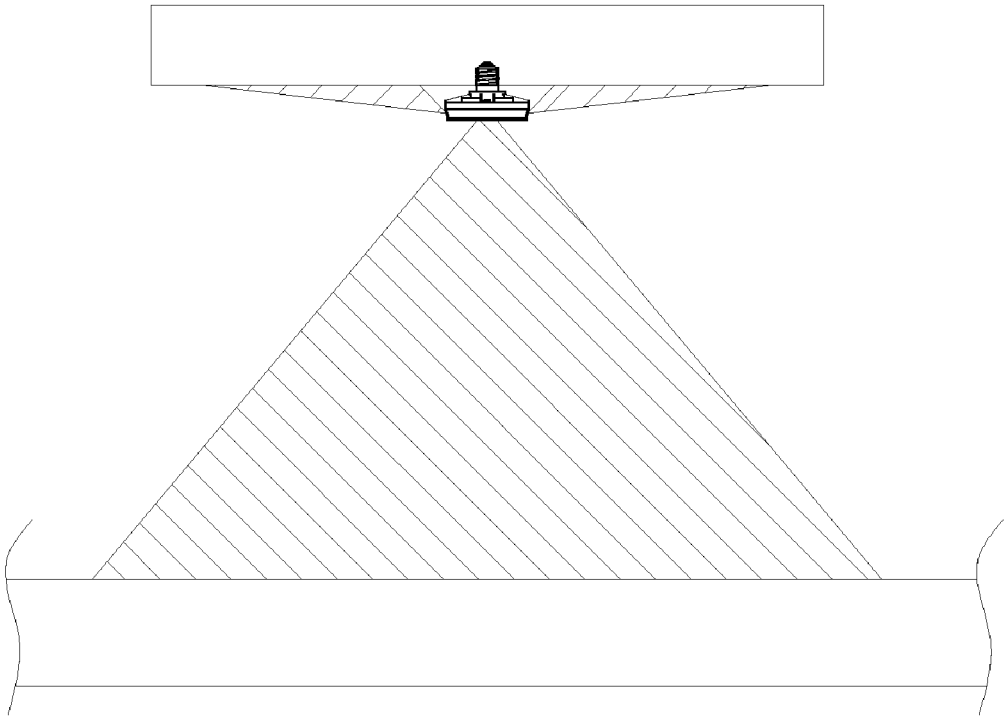
FIG. 7 is a schematic, cross-sectional view showing using the LED illuminating device of FIG. 1 as a ceiling lamp.
Figure 16:
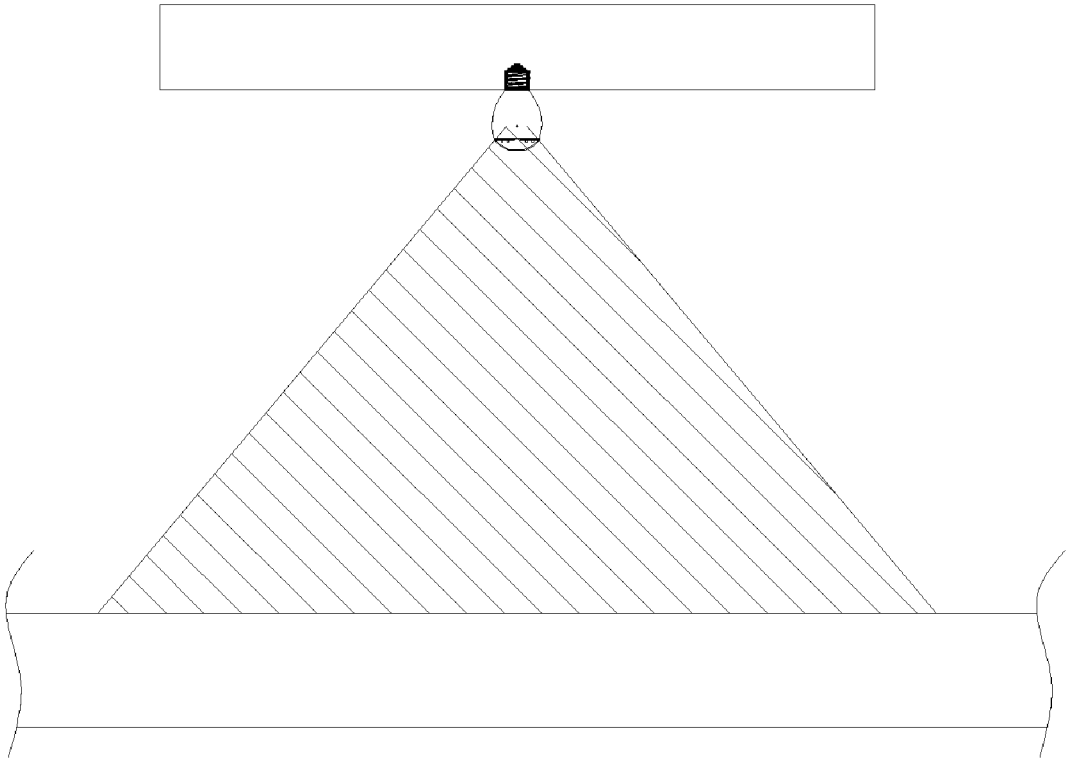
FIG. 16 (RELATED ART)
FIG. 16 is a schematic, cross-sectional view showing using an LED as a ceiling lamp.

Referring to FIG. 4, the first illuminating module 20 illuminates a front side of the LED illuminating device. Referring to FIG. 5, the light emitted by the second group of LEDs 34 is refracted by the light guide 32 and reflected by the reflector 33, thus to change the transmission direction and illuminate a lateral side of the LED illuminating device. FIG. 6 is a light distribution curve chart of the illuminating device of FIG. 1, which shows the illuminating device can illuminate in two different directions at the same time. FIG. 7 shows using the illuminating device of FIG. 1 as a ceiling lamp. FIG. 16 shows using a traditional LED lamp as a ceiling lamp. We can see that in FIG. 16 the traditional LED lamp can only illuminate the floor, yet, in FIG. 7 the illuminating device can illuminate the floor and the ceiling at the same time.

Figure 8:
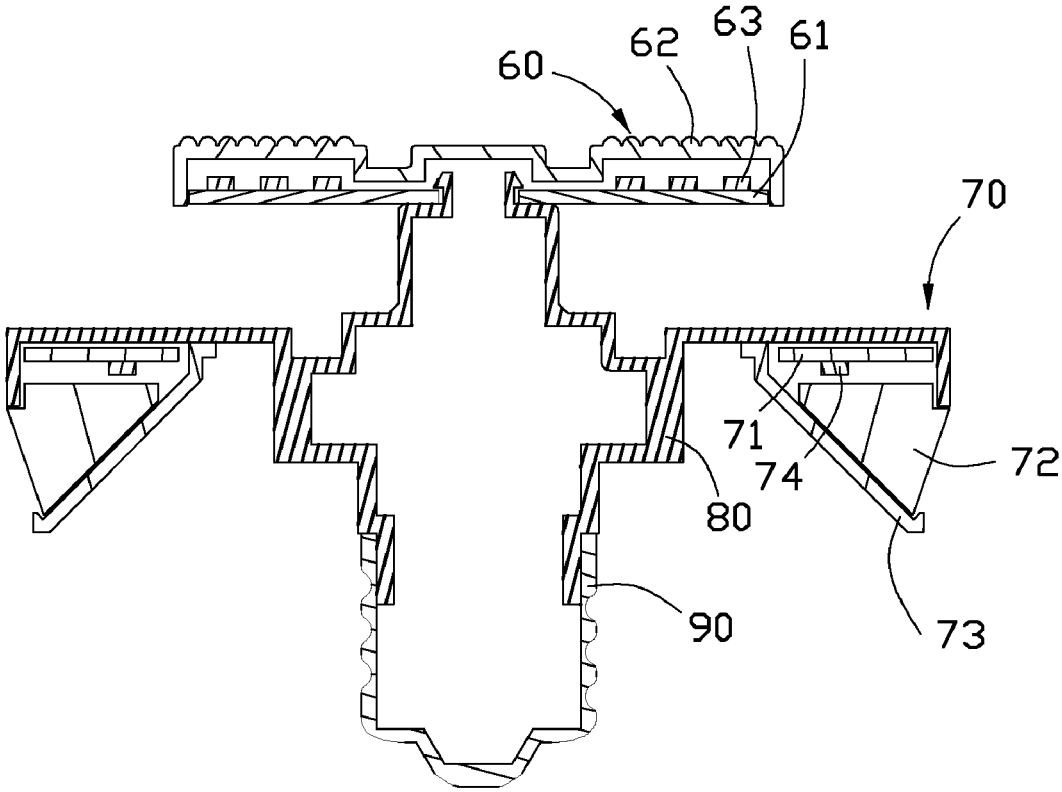
FIG. 8 is a schematic, cross-sectional view of an LED illuminating device according to a second embodiment.
Figure 9:
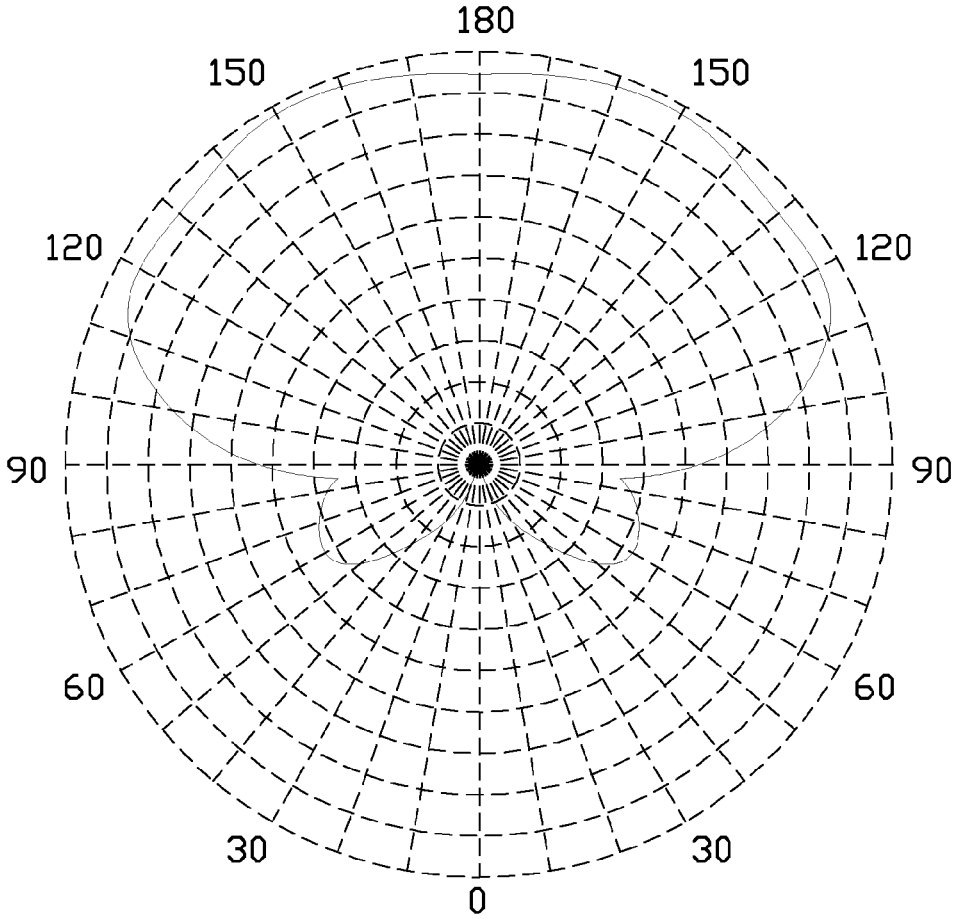
FIG. 9 is a light distribution curve chart of the LED illuminating device of FIG. 8.
Figure 10:
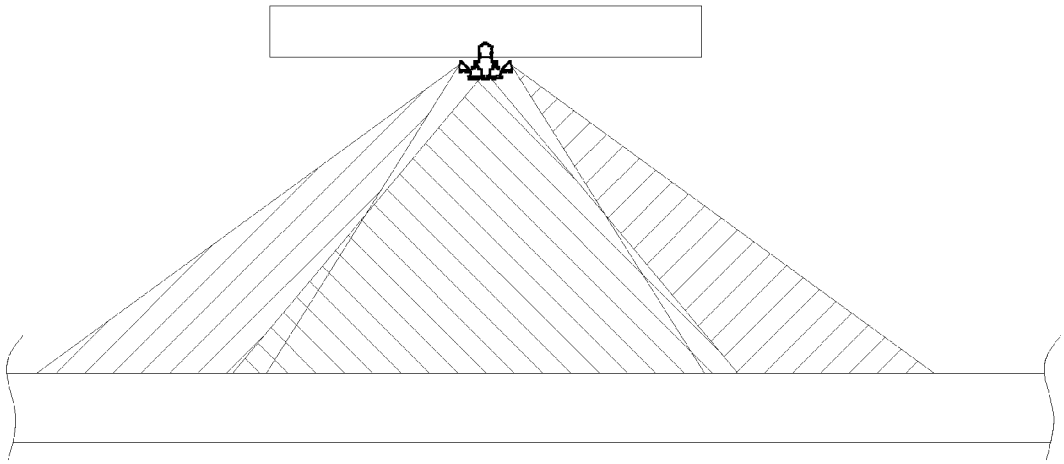
FIG. 10 is a schematic, cross-sectional view showing using the LED illuminating device of FIG. 8 as a ceiling lamp.

Referring to FIG. 8, an LED illuminating device according to a second embodiment is disclosed, which is similar to the illuminating device in FIG. 1, but different in the second illuminating module 70. That is, the first substrate 61 of the first illuminating module 60 and the second substrate 71 of the second illuminating module 70 face the opposite directions, accordingly, the first group of LEDs 63 and the second group of LEDs 74 also face the opposite directions. FIG. 9 is a light distribution curve chart of the illuminating device of FIG. 8, which shows the illuminating device only illuminating in one direction, but having a large light divergence angle. FIG. 10 shows using the illuminating device as a ceiling lamp. We can see that the illuminating device can illuminate more areas than in the traditional way shown in FIG. 16.

Figure 11:
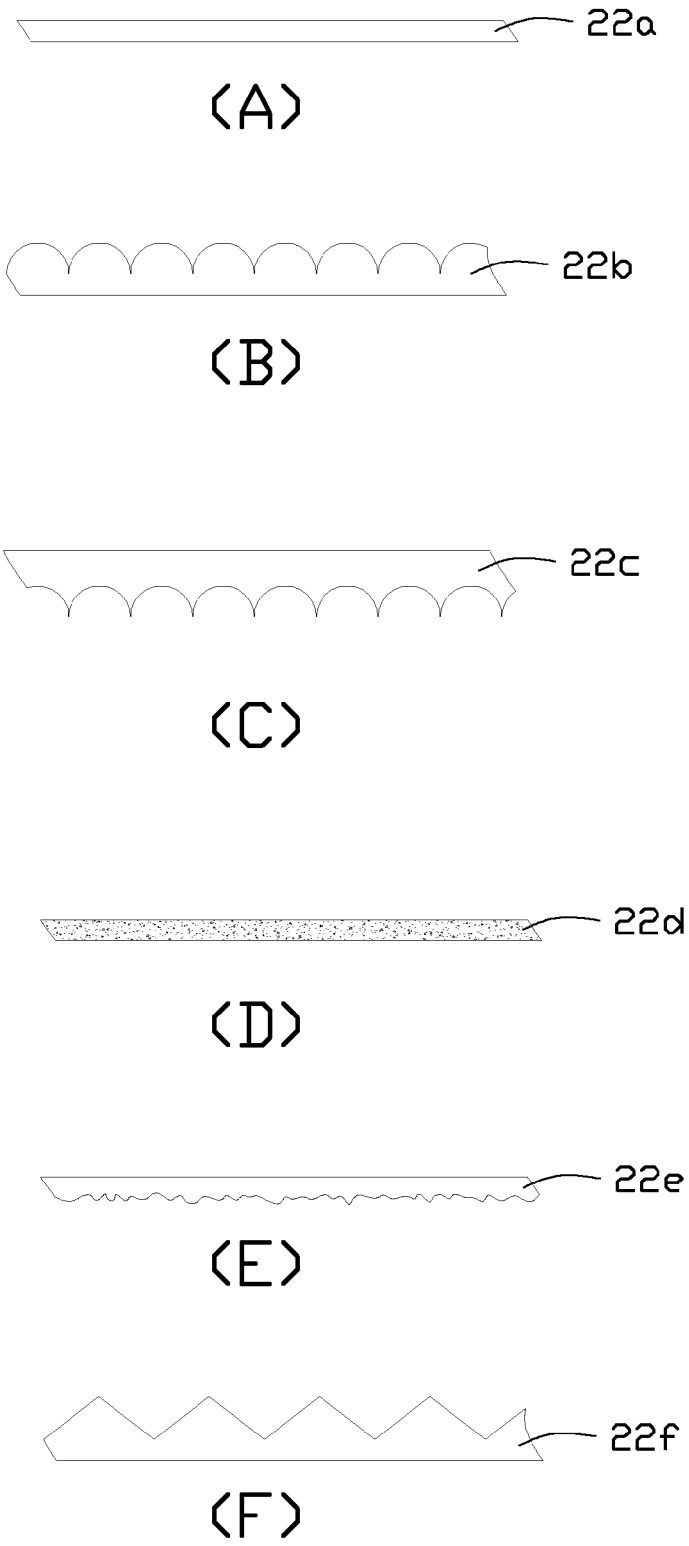
FIG. 11 are enlarged, cross-sectional views showing different transparent covers of the LED illuminating device of FIG. 1.
Figure 12:
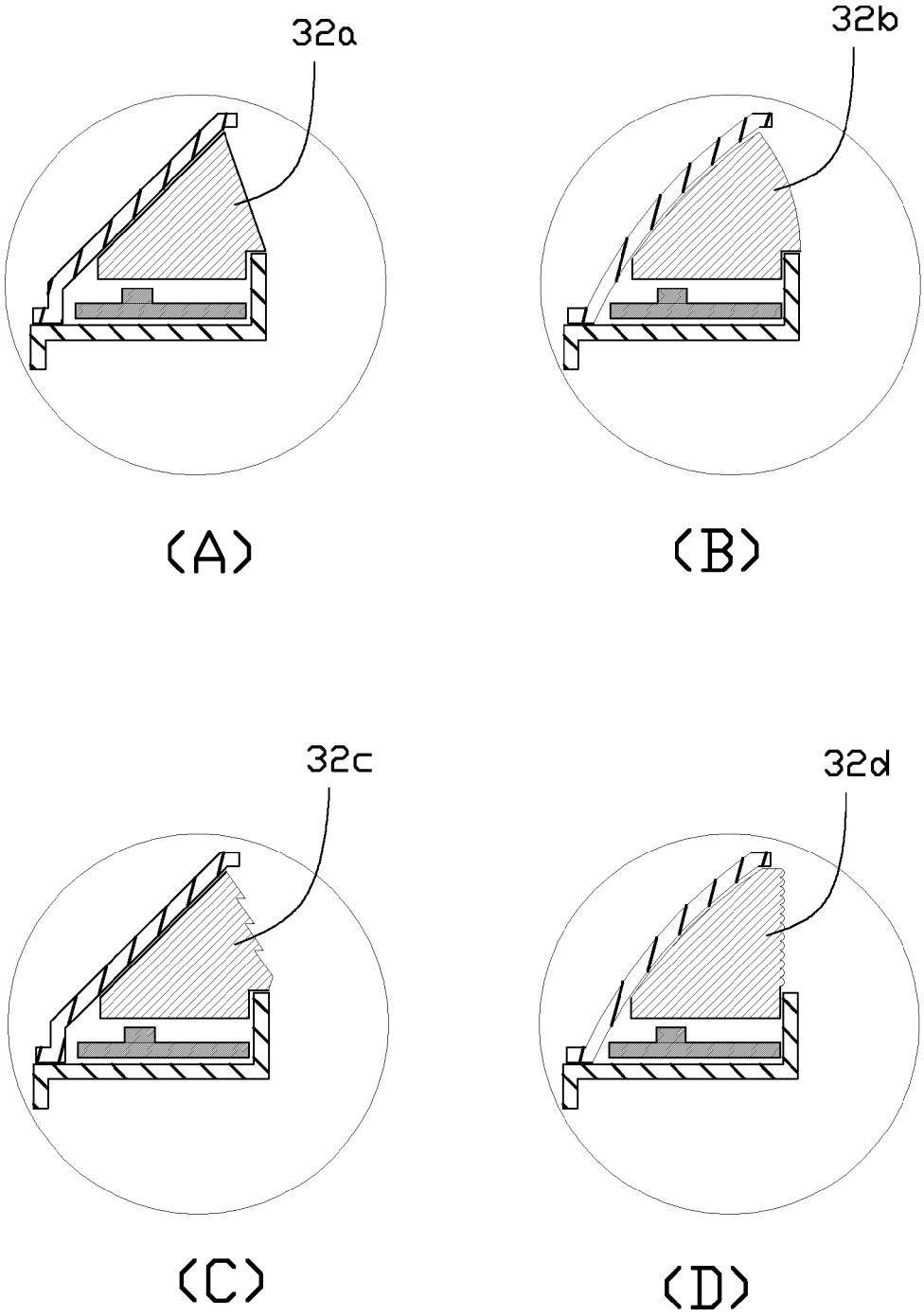
FIG. 12 are enlarged, cross-sectional views showing different wedge shaped light guide of the LED illuminating device of FIG. 1.
Figure 13:
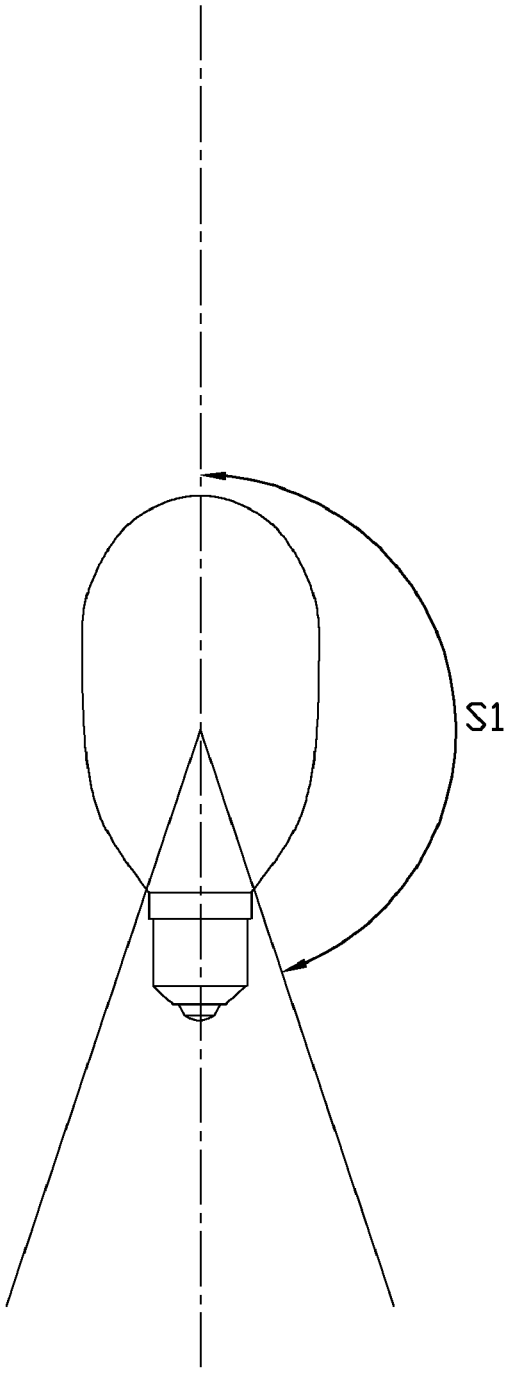
FIG. 13 (RELATED ART)
FIG. 13 is a schematic view showing the light divergence angle of a traditional light source.
Figure 14:
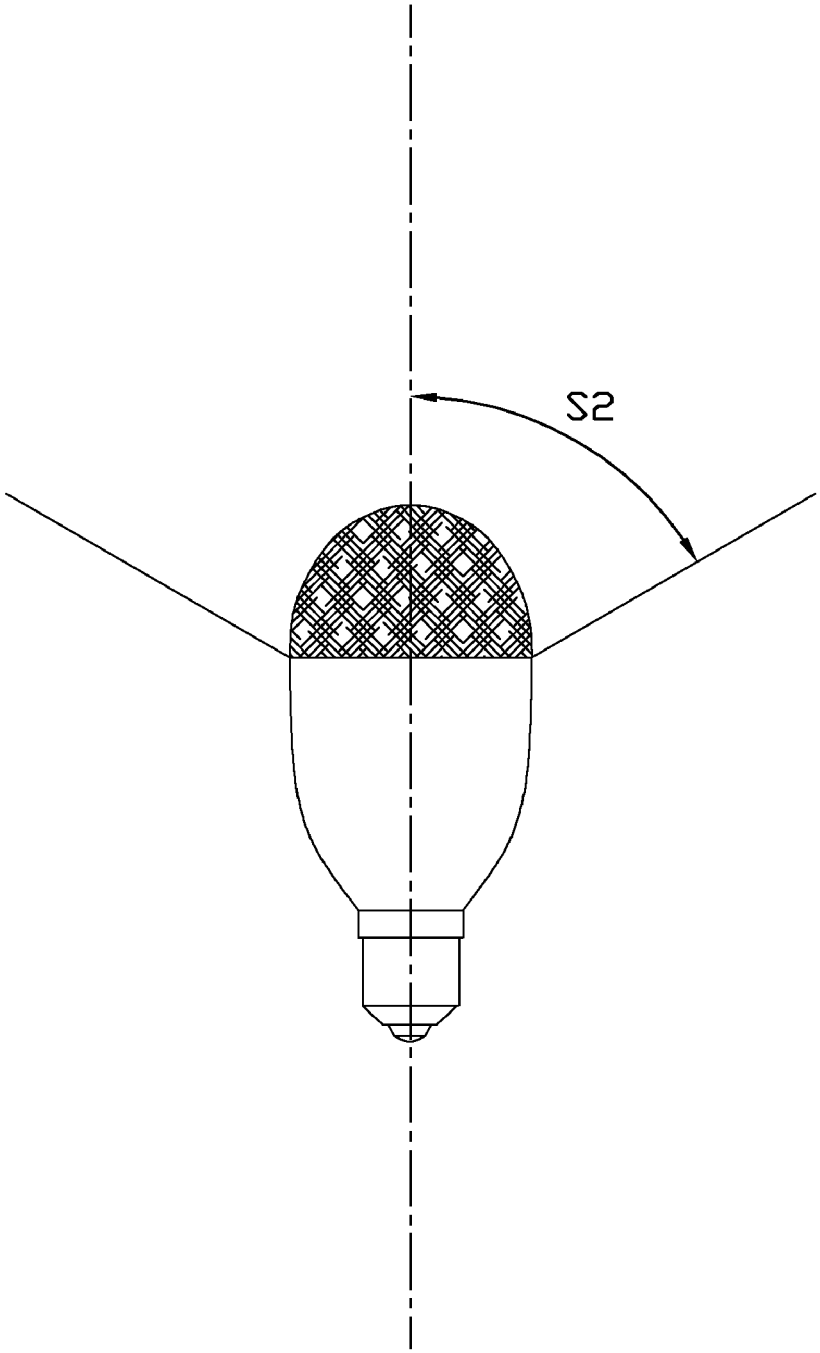
FIG. 14 (RELATED ART)
FIG. 14 is a schematic view showing the light divergence angle of an LED in related art.
Figure 15:
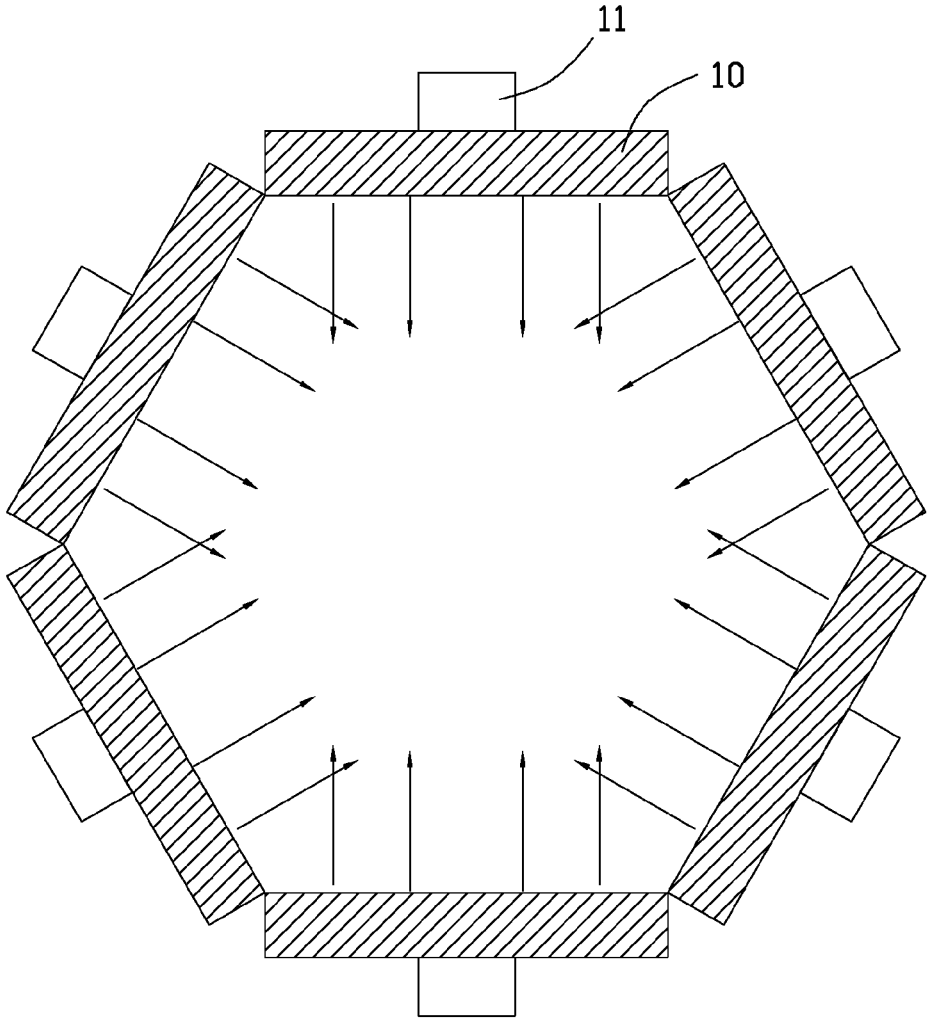
FIG. 15 (RELATED ART)
FIG. 15 is a schematic view showing heat dissipation of a ring shaped LED illuminating device in related art.

The transparent cover 22, the wedge shaped light guide 32 may be varied in shape and structure to achieve different illumination effects. Referring to FIG. 11, different types of the transparent covers 22 are shown with different structures. The transparent cover 22*a* is a normal transparent cover with a smooth surface. The transparent cover 22*b* includes bumps on its outer surface, which gather light. The transparent cover 22*c* defines concavities on its inner surface, which refract light and change the transmission direction of the light. Diffusion particles are added to the transparent cover 22*d* to scatter light. The transparent cover 22*e* has a roughness surface, which diffuse light. The transparent cover 22*f* includes triangular structures on its outer surface, which refract light.

Referring to FIG. 11, different types of the wedge shaped light guide 32 are shown with different structures. The light guide 32*a* is a normal light guide with a smooth surface. The light guide 32*b* has a curved light exiting surface, which reduce reflectivity of the light guide 32*b*. The light guide 32*c* includes triangular structures on its light exiting surface, which further refract light. The light guide 32*d* includes bumps on its light exiting surface, which gather light.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. An LED illuminating device comprising:

a first LED illuminating module comprising a first substrate and a first group of LEDs mounted on the first substrate;

a second LED illuminating module comprising a second substrate carrying a second group of LEDs, a wedge shaped light guide, and a reflector, wherein the second substrate and the reflector defines a fan shaped space therebetween to receive the wedge shaped light guide, and the projections of the first substrate and the second substrate are spaced to each other; and a connecting module connecting the first LED illuminating module with the second LED illuminating module.

2. The LED illuminating device of claim 1, further comprising a transparent cover mounted on the first substrate.

3. The LED illuminating device of claim 2, wherein the transparent cover is one selected from the group consisting of a transparent cover with a smooth surface, a transparent cover comprising bumps on its outer surface, a transparent cover defining concavities on its inner surface, a transparent cover with diffusion particles, and a transparent cover comprising triangular structures on its outer surface.

4. The LED illuminating device of claim 1, wherein the first group of LEDs and the second group of LEDs face opposite directions.

5. The LED illuminating device of claim 1, wherein the first group of LEDs and the second group of LEDs face the same direction.

6. The LED illuminating device of claim 1, wherein the wedge shaped light guide is one selected from the group consisting of a wedge shaped light guide with a smooth surface, a wedge shaped light guide comprising a curved light exiting surface, a wedge shaped light guide comprising triangular structures on its light exiting surface, and a wedge shaped light guide comprising bumps on its light exiting surface.

7. An LED illuminating device comprising:

a substrate; and a first group of LEDs and a second group of LEDs mounted on the substrate, wherein the projections of the first group of LEDs and the second group of LEDs are spaced to each other;

a reflector mounted on the substrate above the second group of LEDs, wherein the substrate and the reflector defines a fan shaped space therebetween; and a wedge shaped light guide received in the fan shaped space.

8. The LED illuminating device of claim 7, further comprising a transparent cover mounted on the substrate above the first group of LEDs.

9. The LED illuminating device of claim 8, wherein the transparent cover is one selected from the group consisting of a transparent cover with a smooth surface, a transparent cover comprising bumps on its outer surface, a transparent cover defining concavities on its inner surface, a transparent cover with diffusion particles, and a transparent cover comprising triangular structures on its outer surface.

10. The LED illuminating device of claim 7, wherein the first group of LEDs and the second group of LEDs are mounted on opposite surfaces of the substrate respectively.

11. The LED illuminating device of claim 7, wherein the first group of LEDs and the second group of LEDs are mounted on a same surface of the substrate.

12. The LED illuminating device of claim 7, wherein the wedge shaped light guide is one selected from the group consisting of a wedge shaped light guide with a smooth surface, a wedge shaped light guide comprising a curved light exiting surface, a wedge shaped light guide comprising triangular structures on its light exiting surface, and a wedge shaped light guide comprising bumps on its light exiting surface.

* * * * *